US011458646B2

(12) United States Patent
Strandh

(10) Patent No.: US 11,458,646 B2
(45) Date of Patent: Oct. 4, 2022

(54) METHOD AND APPARATUS FOR REMOVING WRAPPING FROM ROLLS

(71) Applicant: Core Link AB, Falkenberg (SE)

(72) Inventor: Nils Strandh, Villshärad (SE)

(73) Assignee: CORE LINK AB, Falkenberg (SE)

( * ) Notice: Subject to any disclaimer, the term of this patent is extended or adjusted under 35 U.S.C. 154(b) by 29 days.

(21) Appl. No.: 17/245,530

(22) Filed: Apr. 30, 2021

(65) Prior Publication Data

US 2021/0245382 A1 Aug. 12, 2021

Related U.S. Application Data

(62) Division of application No. 15/899,075, filed on Feb. 19, 2018, now abandoned.

(30) Foreign Application Priority Data

Feb. 22, 2017 (SE) ..... 1750189-1

(51) Int. Cl.

| | |
|---|---|
| ***B26D 1/04*** | (2006.01) |
| ***B65B 69/00*** | (2006.01) |
| ***B65H 16/08*** | (2006.01) |
| ***B26D 3/10*** | (2006.01) |
| ***B65H 19/10*** | (2006.01) |

(52) U.S. Cl.

CPC ..... *B26D 1/045* (2013.01); *B26D 3/10* (2013.01); *B65B 69/0033* (2013.01); *B65H 16/08* (2013.01); *B65H 19/105* (2013.01); *B26D 2210/11* (2013.01); *B65H 2301/4189* (2013.01);

(Continued)

(58) Field of Classification Search

CPC ..... B26D 1/045; B26D 3/10; B26D 2210/11; B65H 19/105; B65H 16/08; B65H 2301/415525; B65H 2301/46043; B65H 2301/46044; B65H 2301/4189; Y10S 83/24; B65B 69/0033; B65B 69/005

See application file for complete search history.

(56) References Cited

U.S. PATENT DOCUMENTS

| | | | |
|---|---|---|---|
| 1,151,527 | A | 8/1915 | Lewis |
| 3,543,625 | A | 12/1970 | Rowland |

(Continued)

FOREIGN PATENT DOCUMENTS

| | | | |
|---|---|---|---|
| DE | 2337663 | A1 | 2/1975 |
| DE | 198 48 808 | A1 | 4/2000 |

(Continued)

OTHER PUBLICATIONS

Search Report from Swedish Application No. 1750189-1 dated Aug. 22, 2017.

(Continued)

*Primary Examiner* — Evan H MacFarlane
*Assistant Examiner* — Fernando A Ayala
(74) *Attorney, Agent, or Firm* — Calfee Halter & Griswold LLP

(57) ABSTRACT

In a method for removing a wrapping, such as plastic film, from a roll of material an apparatus is used, which has a roll supporting unit, and a cutting means. The roll supporting unit is configured to rotate the roll supported thereon, and the cutting means is movable into cutting abutment against the envelope surface of the supported roll for removal of the wrapping during rotation of the roll.

10 Claims, 3 Drawing Sheets

(52) U.S. Cl.
CPC ..... *B65H 2301/4604* (2013.01); *B65H 2301/46043* (2013.01); *B65H 2301/46044* (2013.01)

(56) References Cited

U.S. PATENT DOCUMENTS

| | | | | | |
|---|---|---|---|---|---|
| 3,665,603 | A * | 5/1972 | Bilbrey | H02G 1/1231 30/90.7 |
| 4,821,971 | A * | 4/1989 | Watanabe | B65H 19/105 242/562 |
| 4,945,788 | A * | 8/1990 | Matthews | H02G 1/1221 30/90.1 |
| 5,169,082 | A * | 12/1992 | da Silva | B31F 5/022 242/562.1 |
| 5,462,165 | A * | 10/1995 | Thuer | B65D 75/66 53/381.1 |
| 5,467,676 | A | 11/1995 | Hooper et al. | |
| 5,516,221 | A | 5/1996 | Lake | |
| 5,759,350 | A | 6/1998 | Pyron | |
| 5,857,391 | A | 1/1999 | Renstrom | |
| 6,237,870 | B1 | 5/2001 | Kawamura | |
| 6,761,098 | B1 * | 7/2004 | Esping | B65H 19/105 83/578 |
| 7,878,098 | B2 * | 2/2011 | Wallace | B23D 57/02 83/675 |
| 10,414,684 | B2 | 9/2019 | Nicholas | |
| 2003/0019345 | A1 | 1/2003 | Platon | |
| 2004/0244549 | A1 | 12/2004 | Mitchell | |
| 2005/0132852 | A1 | 6/2005 | Walsh | |
| 2012/0187091 | A1 | 7/2012 | Grzyb | |
| 2014/0000429 | A1 * | 1/2014 | Fujihara | B26D 5/00 83/76.6 |
| 2017/0064908 | A1 | 3/2017 | Sell | |
| 2018/0236679 | A1 * | 8/2018 | Strandh | B65H 16/08 |

FOREIGN PATENT DOCUMENTS

| | | | |
|---|---|---|---|
| EP | 0528351 | A1 | 2/1993 |
| EP | 1698579 | A2 | 9/2006 |
| JP | S61 168495 | A | 7/1986 |
| JP | H02124080 | * | 5/1990 |
| JP | H02124080 | A | 5/1990 |
| JP | H04 311438 | A | 11/1992 |
| JP | H11321828 | * | 11/1999 |
| JP | H11321828 | A | 11/1999 |
| JP | 2001206325 | * | 7/2001 |
| JP | 2001206325 | A | 7/2001 |
| WO | 9317946 | A1 | 9/1993 |

OTHER PUBLICATIONS

Extended European Search Report from European Application No. 18157540.8 dated Apr. 30, 2018 (6 pages).

* cited by examiner

METHOD AND APPARATUS FOR REMOVING WRAPPING FROM ROLLS

CROSS-REFERENCE TO RELATED APPLICATIONS

This application is a divisional application of U.S. Ser. No. 15/899,075, filed on Feb. 19, 2018, which claims priority to Swedish Patent Application No. 1750189-1 filed on Feb. 22, 2017, the entire contents of which are hereby incorporated by reference as if recited in their entirety.

TECHNICAL FIELD

The present invention relates to a method of stripping or removing a wrapping from a roll of material, as well as an apparatus for such stripping/removal.

BACKGROUND

In the industries of e.g. diapers or sanitary pads, a paper material such as roll pulp may be used as fill or absorption material. The producers receive the material wound on a core or sleeve and wrapped in a wrapping, in most cases a plastic wrapping with the purpose to maintain the moisture level of the material.

In the current situation, the wrapping is removed manually by means of a knife. This is not an optimal procedure, since handling a knife is a safety risk and may expose the operator for injuries in the working environment. Many companies wish to exclude operator used knives from their production sites, and internal company prohibitions exist. An apparatus using a person holding a cutting tool such as a knife in order to remove a protective layer from an end surface of a roll is disclosed in WO 93/17946.

Hence, there is a need to find a way of removing the wrapping from a roll of material in a safe and yet efficient manner.

SUMMARY

An object of the present invention is to provide a new method for stripping or removing a wrapping from a roll of material which is improved over prior art and which eliminates or at least mitigates the drawbacks discussed above. More specifically, an object of the invention is to provide such a method for stripping that is safe and yet efficient. Another object of the invention is to provide an apparatus for stripping or removal of wrapping. These objects are achieved by the technique set forth in the appended independent claims with preferred embodiments defined in the dependent claims related thereto.

In a first aspect of the invention, there is provided a method for removing a wrapping, such as plastic film, from a roll of material.

The roll has a cylindrical body, a first roll body end portion with a first end gable, and a second roll body end portion with a second end gable. The method comprises the steps of:

Moving a cutting means into abutment against the wrapping at said first roll body end portion such that the wrapping is punctured.

Rotating the roll about its center axis over a rotational angle from 270 to 360 degrees, at the same time as the wrapping is cut by the cutting means at said first roll body end portion, the cutting means forming an end portion cutting angle relative said first end gable of the first end portion.

Moving the cutting means axially along the center axis of the roll towards said second roll body end portion and at the same time rotating the roll about said center axis such that the wrapping on an envelope surface of the roll is cut in a helical manner. The wrapping on the envelope surface of the roll is cut with the cutting means forming an envelope surface cutting angle relative said first end gable of said first end portion. The envelope surface cutting angle is larger than the end portion cutting angle.

Rotating the roll further about its center axis over the rotational angle from 270 to 360 degrees, at the same time as the wrapping is cut by the cutting means at said second roll body end portion, the cutting means forming said end portion cutting angle.

Thereby, the wrapping is cut off the roll automatically and in one continuous piece. This method is advantageous since the wrapping is cut off the roll automatically and in one continuous piece. There is thus no need for a knife to be used. This also facilitates the handling of the leftover wrapping material.

The cutting means may be inclined by the envelope surface cutting angle during the cutting of the wrapping along the envelope surface of the roll. Thereby, the envelope surface of the roll may be cut in a helical manner.

In one embodiment, the envelope surface cutting angle is between 5 and 25 degrees, preferably between 10 and 20 degrees, and most preferred approximately 15 degrees. Depending on the diameter of the roll, different envelope surface cutting angles are preferred, in order to get a balance between speed of operation and a manageable width of the cut off wrapping. The larger diameter of the roll, the smaller the angle required.

In one embodiment, the wrapping on the respective roll body end portions is cut for less than a 360 degree rotation of the roll, with the cutting means inclined by the end portion cutting angle which is between 0 and 10 degrees, preferably between 0 and 5 degrees, and most preferred between 0 and 2 degrees, in relation to said first end gable of said first roll body end portion. It facilitates the removal of the end portions of the wrapping since they do not get caught around the end portions of the roll. Thereby, the wrapping is kept in one piece, comprising two end portions and a spiral-shaped portion there between.

Preferably, the wrapping is gripped by a collecting means, and the cut off wrapping is preferably gathered by the collecting means. It is preferred to use a collecting means to gather the cut off wrapping since it provides for a fully automated process of removing the wrapping. In another embodiment, the cut off wrapping is taken care of by a worker, which may be preferred in other situations.

In a second aspect, there is provided an apparatus for removal of wrapping, such as a plastic film, from a roll of material. The roll has a cylindrical body, a first roll body end portion with a first end gable, a second roll body end portion with a second end gable and an envelope surface. The apparatus comprises a roll supporting unit configured to rotate the roll supported thereon, and a cutting means, which during rotation of the roll is movable into cutting abutment against the envelope surface of the supported roll and along a center axis of the roll. The cutting means is configured to form an end portion cutting angle relative the first end gable of the first end portion and to form an envelope surface cutting angle relative the first end gable of the first end portion. The envelope surface cutting angle is larger than the end portion cutting angle, such that the wrapping is automatically removable in one piece during the rotation of the roll. This apparatus is favourable in that it automatically provides for removal of the wrapping from the roll in one continuous piece. The apparatus provides a possibility to cut the wrapping in a helical manner both along the envelope surface of the roll and/or along the end surface portions, whichever is preferred. This facilitates an efficient removal of the wrapping.

In another embodiment, the apparatus further comprises a conveyor arranged to transport the roll to the roll supporting unit, and/or from the roll supporting unit. This is favourable if the apparatus is designed as a part of a process line. The conveyor can transport the roll from a receiving station, to the unwrapping station, and further along the process line.

Preferably, the roll supporting unit comprises at least two rotatable cylinders arranged to apply a lifting force to the roll. This is advantageous in that the roll is free to rotate on the cylinders. If it has been transported by the conveyor, it is lifted from the conveyor, to become rotatable.

Further, the apparatus preferably comprises a carrier for supporting the cutting means. This is advantageous in that the cutting means becomes movable along the roll. The roll is stationary during the cutting procedure, and the cutting means is moved.

In one embodiment, the end portion cutting angle is between 0 and 10 degrees, preferably between 0 and 5 degrees, and most preferred between 0 and 2 degrees. This provides for the cutting means to be inclined at different angles during the cutting procedure, which may be advantageous when cutting different portions of the wrapping.

Preferably, the roll of material comprises paper material, preferably roll pulp material. This is a material often used in e.g. diapers and other sanitary products.

The cutting means may comprise a cutting blade or knife. This is advantageous when puncturing the wrapping.

BRIEF DESCRIPTION OF THE DRAWINGS

Embodiments of the invention will be described in the following; references being made to the appended diagrammatical drawings which illustrate non-limiting examples of how the inventive concept can be reduced into practice.

DETAILED DESCRIPTION OF EMBODIMENTS

Hereinafter, certain embodiments will be described more fully with reference to the accompanying drawings. The invention may, however, be embodied in many different forms and should not be construed as limited to the embodiments set forth herein; rather, these embodiments are provided by way of example so that this disclosure will be thorough and complete, and will fully convey the scope of the invention, such as it is defined in the appended claims, to those skilled in the art.

Figure 1:
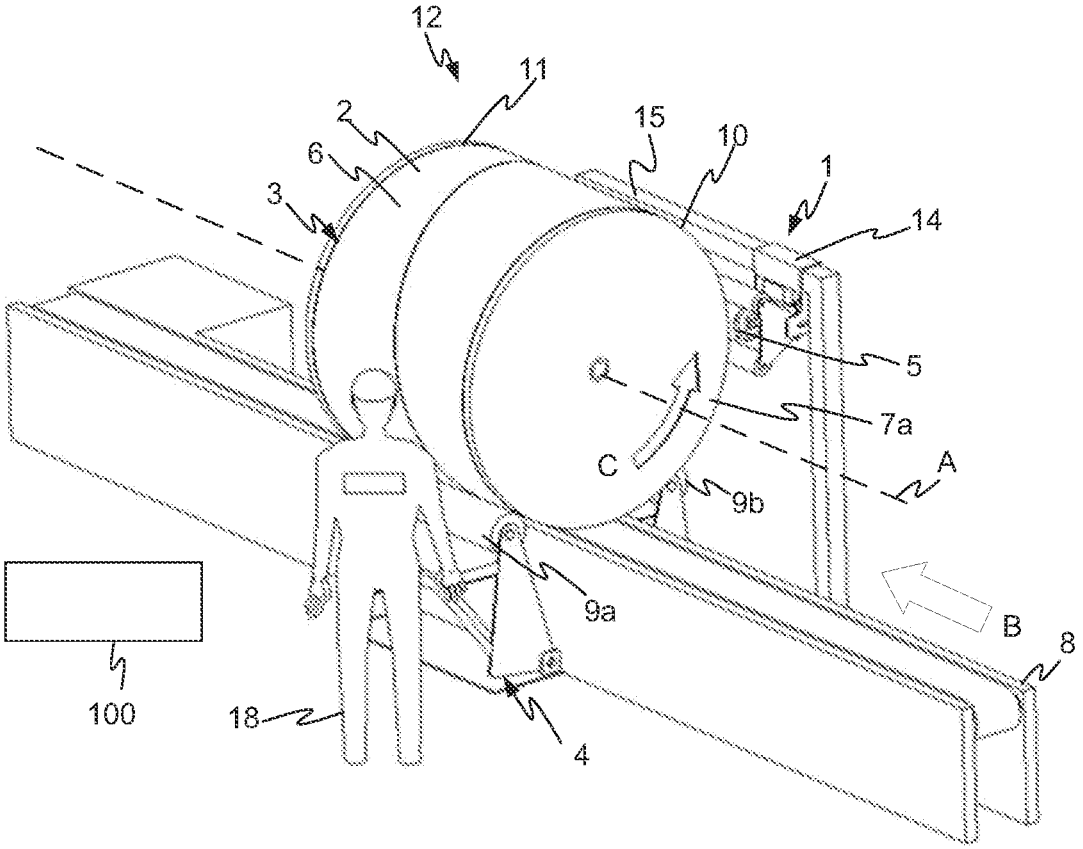
FIG. 1 is an isometric view of a stripping apparatus.
Figure 2:
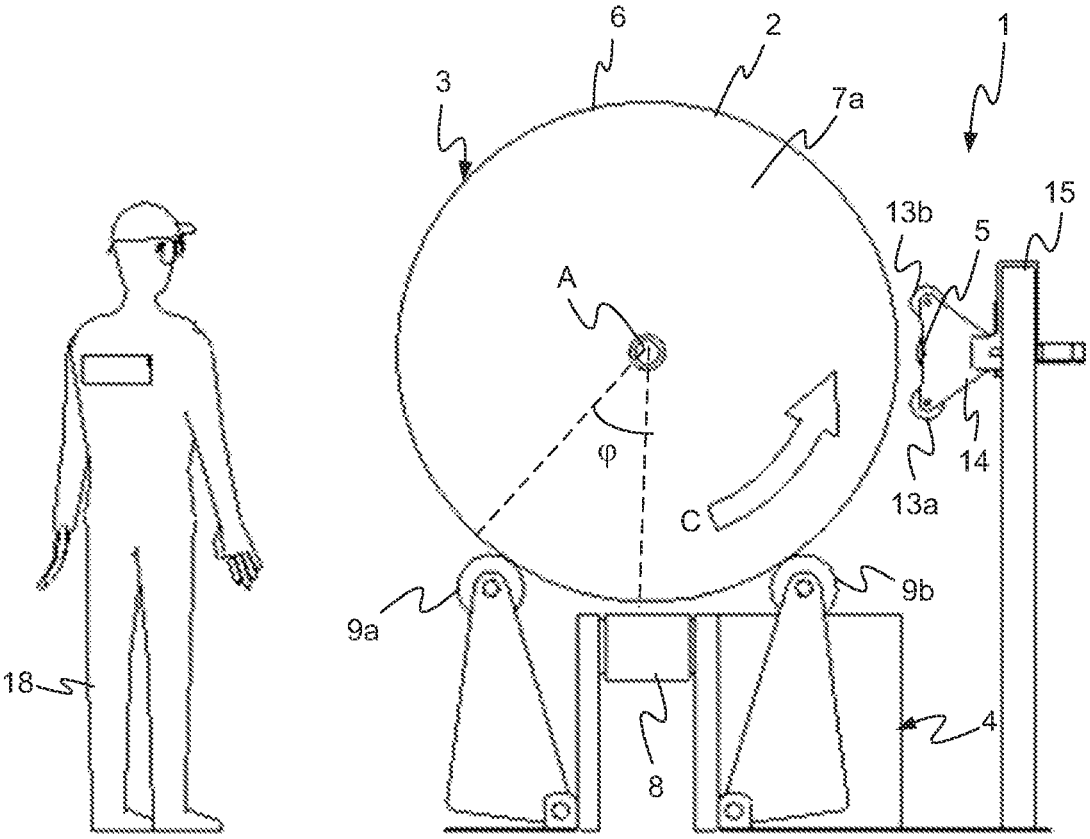
FIG. 2 is an end view of the stripping apparatus in FIG. 1.
Figure 3:
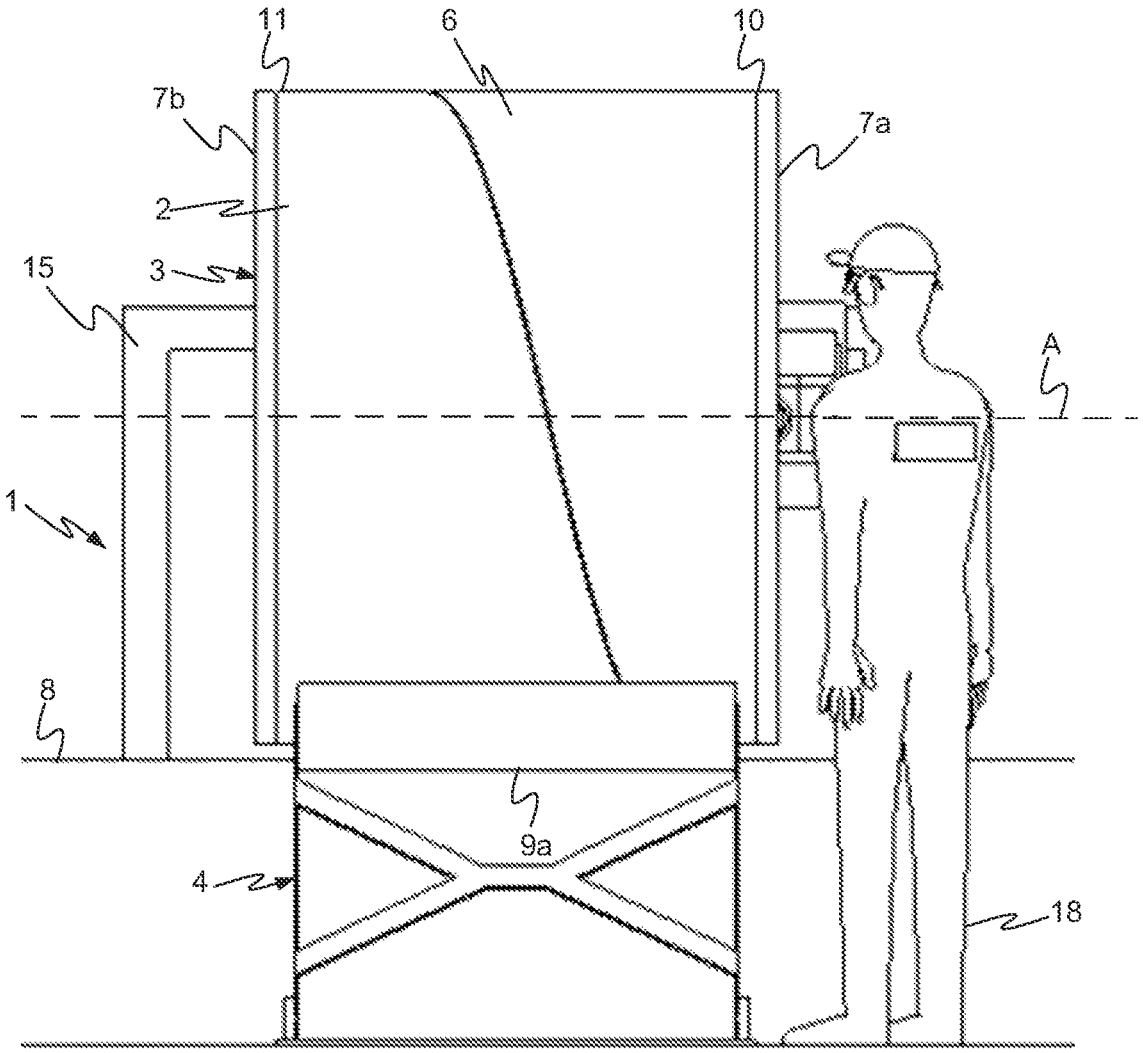
FIG. 3 is a side view of the stripping apparatus in FIGS. 1-2.

In FIGS. 1-3, an apparatus 1 for stripping, unwrapping or removing a wrapping 2 from a roll 3 of material is shown. The roll 3 is a cylindrical roll having two ends or gables 7*a*, 7*b* and an envelope surface 6. The roll 3 has a longitudinal, central axis (A), around which the roll 3 is rotatable.

The apparatus 1 has a stripping station 12 where a roll 3 is placed in order to be stripped from its wrapping 2. In this embodiment, the roll 3 comprises roll pulp wound about a core cylinder (not shown). The thickness of each layer of roll pulp is approximately 1-2 mm. The shown roll 3 is wrapped in a plastic film 2 for preserving the moisture level in the material. In other embodiments, the roll 3 may be wrapped in plastic, with an extra plastic reinforcement around an end periphery, or with protective discs of corrugated paper incorporated in the wrapping at the end surfaces, i.e. top and bottom surfaces or the gables 7*a*, 7*b*, of the roll 3.

Furthermore, the apparatus 1 comprises a roll supporting unit 4 and a movable cutting means 5. In this embodiment, the apparatus 1 also comprises a conveyor 8, whereas in other embodiments (not shown) this is omitted.

The roll supporting unit 4 comprises two horizontal rotatable lifting cylinders 9*a*, 9*b*. At least one of the cylinders 9*a*, 9*b* is driven by a drive unit (not shown). If only one of the cylinders 9*a*, 9*b* is driven, the other one is freely rotatable. Alternatively, both lifting cylinders are driven by the drive unit. In the shown embodiment, one of the cylinders 9*b* is driven. At least one of the lifting cylinders 9*a*, 9*b* is horizontally movable towards/from the other cylinder 9*a*, 9*b*. In the described embodiment, only one of the cylinders 9*a* is horizontally movable. In the shown configuration, it is favourable to keep the driven cylinder 9*a* non-moving, since it is more cumbersome and causes more wear on the drive unit if it is moved back and forth. In other embodiments, it may instead be advantageous to let the driven cylinder 9*a* be moveable. The conveyor 8 is arranged between and extends in the same direction as the two lifting cylinders 9*a*, 9*b*, see FIG. 2.

The apparatus 1 further comprises two horizontal rotatable support cylinders 13*a*, 13*b* included in a carrier 14 and preferably having the same length as the roll 3. The cutting means 5 is arranged vertically in between the two support cylinders 13*a*, 13*b*. In the described embodiment, the cutting means 5 is suspended on the carrier 14 which is arranged movably on a vertical rack 15. The support cylinders 13*a*, 13*b* are also arranged on the rack 15, but they are not movable along the rack 15, instead they are only movable into abutment against the roll 3. The cutting means 5 is thus movable between the non-moving support cylinders 13*a*, 13*b*. In another embodiment (not shown), the cutting means 5 and the support cylinders 13*a*, 13*b* may be arranged on one rack each, or in any other suitable manner.

When a roll 3 is placed in the stripping station 12, it is lifted or elevated by the lifting cylinders 9*a*, 9*b*. The length of the lifting cylinders 9*a*, 9*b* is less than the length of the roll 3. This is best seen in FIG. 3. The length of the support cylinders 13*a*, 13*b* is the same as the length of the roll 3.

The cutting means 5 is here illustrated by a disc shaped, circular blade. In other embodiments, the cutting means 5 may be differently shaped or alternatively designed. The cutting means 5 is movable in four ways:

1) Towards/from the roll 3, this movement may be a linear movement, e.g. in the radial direction, towards the roll 3, or a curve shaped, rotary movement towards the surface of the roll 3. This movement is accomplished either by moving the cutting means 5 alone, i.e. moving the carrier 14, or by moving the rack 15, or a combination of both.

2) Axially back and forth in parallel along a longitudinal axis A of the roll 3, from a first end portion 10 of the roll 3 towards a second end portion 11. This movement is accomplished by moving the cutting means 5, i.e. moving the carrier 14, along the rack 15.

3) Vertically inclinable in relation to a plane of a base portion 7*a*, 7*b* of the roll 3. This movement is accomplished by inclining the carrier 14. In another embodiment, it could be accomplished by inclining the rack 15.

4) Rotatable around its own center axis. The cutting means 5 may thus rotate when it is in contact with the roll 3. In another embodiment (not shown), means for securing the rotatable cutting means 5 such that it cannot rotate may be provided.

The cutting means 5 is preferably spring-loaded such that a preferred and pre-determined pressure is applied to the plastic wrapping 2 of the roll 3. The pressure should be enough to puncture the wrapping 2, which possibly is wrapped in several layers, but not too deep into the underlying material. A person cutting the wrapping 2 manually according to prior art by means of a knife may cut to deep, whereas it is easier to apply a predetermined amount of pressure by means of a spring-loaded and possibly computer controlled cutting means 5 of the type described herein.

An alternative apparatus may comprise only one support cylinder (not shown). The cutting means 5 may be located close to a floor surface instead of being elevated as in the described embodiment. In yet another embodiment, the cutting means 5 may be arranged flush with the floor surface (not shown). An elevated position is advantageous, though, in that it is a comfortable height for a maintenance worker. A position close to or submerged into the floor is advantageous in that the occupied space is smaller compared to the elevated position, and that it provides more options regarding the further configuration of the processing line.

The explanatory apparatus described above is operated in the following manner.

A roll 3 of wrapped material, preferably roll pulp, is transported by the conveyor 8 to the stripping station 12 in a direction marked with arrow B in FIG. 1. The lifting cylinders 9*a*, 9*b* cooperate such that the roll 3 is elevated a distance from the conveyor 8. This is accomplished by reducing the horizontal distance between the cylinders 9*a*, 9*b* by moving the movable cylinder 9*a* closer towards the non-movable cylinder 9*b*. The driven cylinder 9*b* is then made to rotate such that the roll 3 is being rotated on the cylinders 9*a*, 9*b* in a rotational direction marked with arrow C in FIG. 1. Alternatively, the cylinders 9*a*, 9*b* are rolling constantly, also when the roll 3 of wrapped material is moved to the stripping station 12, and when it is being elevated. Preferably, the roll 3 rotates such that it moves in an upwards direction passing the cutting means 5. See arrow C in FIGS. 1 and 2.

The cutting means 5, directed substantially in parallel to a plane of the gables 7*a*, 7*b* of the roll 3, moves into cutting abutment against the envelope surface 6 of the up-lifted and rotating roll 3. In another embodiment, the cutting means 5 is first moved, and thereafter, the roll 3 is made to rotate.

Enough pressure is exerted such that the plastic wrapping 2 is punctured. If the wrapping 2 comprises several layers of plastic film, all layers are cut through.

From the moment the cutting means 5 cuts through wrapping 2, the roll 3 is let to rotate a maximum of less than 360°. Preferably, the roll 3 rotates φ degrees (See FIG. 2), where $270° < \varphi < 360°$, at the same time as the wrapping is cut by the cutting means 5.

The gable portion 16*a* of the wrapping 2 is gripped, either by an operator 18, a collecting means (not shown) or by an industrial robot (not shown).

In this embodiment, the cutting means 5 is in contact with the roll 3 of wrapped material when it is being inclined, and the rotation of the roll 3 continues during the inclination of the cutting means 5. In another embodiment, the cutting means 5 is moved away from the roll 3 of wrapped material, inclined, and then brought back into cutting abutment with the roll 3 such that the wrapping 2 is cut by the inclined cutting means 5.

The cutting means 5 is moved by the carrier 14 along the rack 15, in parallel with the axis A of the roll 3, at the same time as the roll 3 continues to rotate. By having the cutting means 5 moving along the roll 3 while being inclined at the same time as the roll 3 rotates, the wrapping 2 is cut in a helical manner on the envelope surface 6 of the roll 3. While the cutting procedure is performed the operator 18, collecting means or a robot pulls the cut off wrapping 2. E.g. the wrapping 2 may be directly disposed of in e.g. a container, or wound to a ball or skein before being disposed of, or it may be gathered in any other suitable way.

When the cutting means 5 has reached the second end portion 11 of the roll 3 and thus has cut the wrapping 2 along the envelope surface 6 of the roll, the cutting means 5 is inclined back to its initial position, in parallel with the plane of the gables 7*a*, 7*b* of the roll 3. The cutting means 5 thereafter cuts the plastic wrapping 2 for a rotation of φ degrees around the roll 3 (FIG. 2), where preferably $270° < \varphi < 360°$. Thus, the wrapping 2 is cut off from the roll 3 and it is free to be gathered by the operator 18, collecting means 100 or robot, and being disposed of, either as trash or for recycling.

Figure 4:
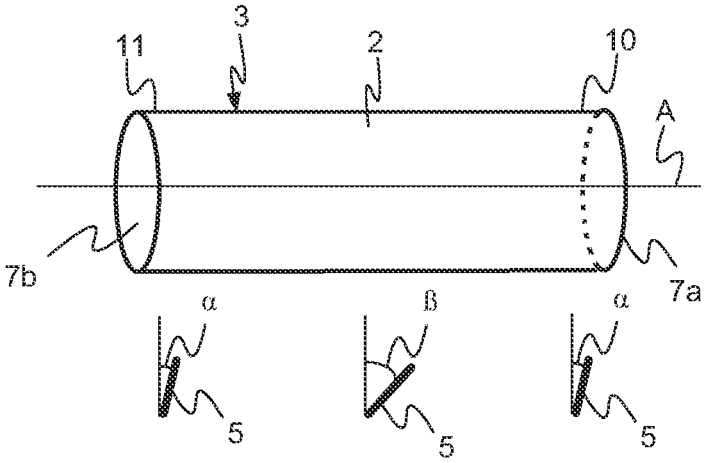
FIG. 4 is a side view of a roll of material disclosing cutting means inclinations.

In an alternative embodiment, shown in FIG. 4, the wrapping 2 is cut at the end portions 10, 11 a small distance axially in on the envelope surface of the roll 3 with the cutting means 5 inclined by an angle of α degrees in relation to a plane perpendicular to the axis A of the roll 3. Further, the wrapping 2 on the envelope surface 6 of the roll 3 is cut with the cutting means 5 inclined by an angle of β degrees. Preferably $0° \leq \alpha < 10°$, more preferably $0° \leq \alpha < 5°$ degrees, and most preferred $0° \leq \alpha < 2°$, and preferably $5° < \beta < 25°$, more preferably $10° < \beta < 20°$, and most preferred β is approximately 15°, and β is larger than α. A soft transition between the two inclinations is thus obtained.

In summary, the method comprises the following steps:

1) Cutting the wrapping 2 at the first end portion 10 for a rotation of φ degrees of the roll 3, where $270° < \varphi < 360°$.

2) Cutting the wrapping 2 along the envelope surface 6 of the roll 3 with the cutting means 5 inclined while the roll 3 is rotating.

3) Cutting the wrapping 2 at the second end portion 11 for a rotation of φ degrees of the roll 3, where $270° < \varphi < 360°$.

The cutting means 5 may be either substantially parallel or inclined by the angle α in relation to the planes of the gables 7*a*, 7*b* of the roll 3 during step 1 and 3.

The result is a continuous piece of wrapping 2 comprising two gable portions and a helical envelope surface there between which can be removed in an efficient manner, either by the operator 18, or mechanically by the collecting means 100 or industrial robot.

The person 18 in the figures is for illustrative purposes only, since the size of the described roll 3 becomes more apparent with a normally sized person 18 as comparison. In other embodiments, the size of the roll may be smaller or larger. The human operator 18 can easily be exchanged for one or more industrial robots or any other suitable mechanical means, such as different sensors.

As an alternative to the method described above, the rotation of the roll 3 is stopped when the cutting means 5 is adjusted for the different cutting maneuvers, while the cutting means 5 is retracted from the surface of the roll, adjusted, and then brought back into contact with the roll 3.

Figure 5:
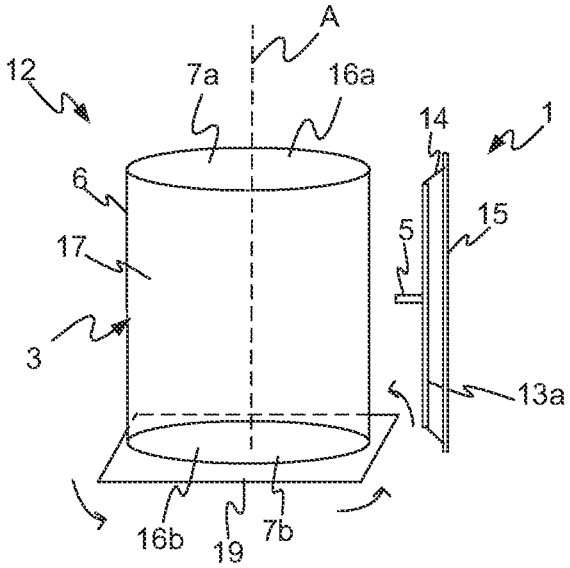
FIG. 5 is a side view of a stripping apparatus according to further embodiment.

In another embodiment, shown in FIG. 5, the roll 3 which is placed in the stripping station 12 is positioned on one of its end surfaces 7*b*. The roll 3 is rotatably arranged, e.g. on a rotatable disc 19, such that it can rotate around its longitudinal axis. The stripping apparatus 1 has the same features as in the previously described embodiments, but is now vertically arranged. The cutting means 5 is movable in the vertical direction, such that the envelope surface 17 of the wrapping 2 is cut in a helical manner when the roll 3 is being rotated. The top end portion 16*a* of the wrapping is cut in the same manner as previously described. The bottom end portion 16*b* of the wrapping is cut by a 360° rotation of the roll, such that the wrapping 2 is separated into two parts. The first part, comprising the envelope surface 17 of the wrapping 2 and the top end surface 16*a* of the wrapping, are removed by a worker, or by a collecting means (not shown). The bottom end portion 16*b* of the wrapping 2, located on the bottom end surface 7*b* of the roll 3, is preferably removed when the roll 3 has been transported away from the unwrapping station 12. Alternatively, both end portions 16*a*, 16*b* of the wrapping is cut as described in the first embodiment, such that the wrapping is removed in one cohesive piece. Then, the cohesive piece of wrapping 2 is removed completely first when the roll 3 has been transported away from the stripping station 12.

As an alternative (not shown), the roll 3 is not rotatably arranged. Instead, the rack 15 on which the cutting means 5 is provided is rotatable around the roll 3 such that the envelope surface 17 of the wrapping 2 is cut in a helical manner.

As another alternative (not shown), the above described method may also be carried out without the conveyor 8. The roll 3 may be transported to the stripping station 12 by other means such as lift trucks or corresponding transportation means.

In another embodiment, the apparatus 1 is provided with a programmable control unit (not shown). The apparatus 1 may also be provided with a bar code reader (not shown) or other scanning sensor which reads a barcode (not shown) provided on the roll 3 by the manufacturer. In this way, the control unit may ensure that a predetermined pressure is applied to the roll 3 by the cutting means 5, that the roll 3 is lifted to a predetermined height by the lifting cylinders 9*a*, 9*b*, that the cutting means 5 is inclined a predetermined degree etc. The pressure, the lifting height, the inclination etc. may be predetermined values, or they may be determined by the information given in the bar code, read by the barcode reader.

Possibly, the apparatus 1 is provided with a control panel (not shown) which is operated by an operator.

FURTHER ASPECTS, EMBODIMENTS AND VARIANTS

In the following, certain aspects, embodiments and variants of the inventive concept are set forth in a number of clauses.

1. A method for removing a wrapping (2), such as plastic film, from a roll (3) of material, the method comprising the steps of:

moving a cutting means (5) into abutment against the wrapping (2) at a first end portion (10) of the roll (3) such that the wrapping (2) is punctured, and moving the cutting means (5) axially along a longitudinal axis (A) of the roll (3) towards a second end portion (11) of the roll (3) and at the same time rotating the roll (3) such that the wrapping (2) on an envelope surface (6) of the roll (3) is cut in a helical manner.

2. The method of clause 1, wherein the cutting means (5) is inclined by an angle (β) during the cutting of the wrapping (2) along the envelope surface (6) of the roll (3), wherein said inclined angle (β) follows: $5° < \beta < 25°$, preferably $10° < \beta < 20°$, and most preferred said inclined angle (β) is approximately 15°.

3. The method of clause 1 or 2, wherein the wrapping (2) on the respective end portions (10, 11) is cut for less than a 360° rotation of the roll (3), with the cutting means (5) inclined by an end cutting angle (α) of $0° \leq \alpha < 10°$, preferably $0° \leq \alpha < 5°$, and most preferred $0° \leq \alpha < 2°$, in relation to a plane of an end surface (7*a*, 7*b*) of the roll (3), such that the wrapping (2) is removable in one integral piece.

4. The method of any of the preceding clauses, wherein the wrapping (2) is gripped by a collecting means (100), and wherein the cut off wrapping (2) is gathered by the collecting means (100).

5. An apparatus for removal of wrapping (2) from a roll (3) of material, the apparatus comprising:

a roll supporting unit (4), and a cutting means (5), wherein the roll supporting unit (4) is configured to rotate the roll (3) supported thereon and wherein the cutting means (5) is movable into cutting abutment against an envelope surface (6) of said supported roll (3) for removal of the wrapping (2) during rotation of said roll (3).

6. The apparatus according to clause 5, wherein the cutting means (5) is movable along a longitudinal axis (A) of the roll (3) and vertically inclinable in relation to a plane perpendicular to said axis (A) of the roll (3) such that a cut surface provided by the cutting means (5) is inclined compared to said plane.

7. The apparatus of clauses 5 or 6, further comprising a conveyor (8) arranged to transport the roll (3) to the roll supporting unit (4), and/or from the roll supporting unit (4).

8. The apparatus of any one of the clauses 5-7, wherein the roll supporting unit (4) comprises at least two rotatable cylinders (9*a*, 9*b*) arranged to apply a lifting force to the roll (3).

9. The apparatus of any one of the clauses 5-8, further comprising a carrier (14) for supporting the cutting means (5).

10. The apparatus of any one of the clauses 5-9, wherein the cutting means (5) is tiltable by an angle, wherein $0° \leq \alpha < 10°$, preferably $0° \leq \alpha < 5°$, and most preferred $0° \leq \alpha < 2°$, in relation to a plane perpendicular to said axis (A) of the roll (3).

11. The apparatus of any one of the clause 5-10, wherein the wrapping (2) comprises a plastic wrapping or film.

12. The apparatus of any one of the clauses 5-11, wherein the roll (3) of material comprises paper material, preferably roll pulp material.

13. The apparatus of any one of the clauses 5-12, wherein the cutting means comprises a cutting blade or knife (5).

Modifications and variations of the embodiments of the above invention that would be obvious to a person of ordinary skill in the art are deemed to be within the scope of the present invention the nature of which is to be determined from the above description and the appended claims.

The invention claimed is:

1. A method for removing a wrapping from a roll of material, said roll having a center axis, a cylindrical roll body, a first roll body end portion with a first roll end gable, a second roll body end portion with a second roll end gable, and a roll envelope surface between the first roll body end portion and the second roll body end portion, said wrapping having an envelope portion covering said roll envelope surface, a first envelope end portion covering said first roll end gable and a second envelope end portion covering said second roll end gable, the method comprising the steps of:

moving a single cutting means into abutment against the wrapping at said first roll body end portion such that the wrapping is punctured;

rotating the roll about the center axis of the roll over a rotational angle (φ) less than 360 degrees, at the same time as the wrapping is cut by the cutting means at said first roll body end portion, the cutting means inclining and forming an end portion cutting angle (α) in relation to a plane perpendicular to said center axis of said roll during cutting of the first envelope end portion or the second envelope end portion, wherein the first envelope end portion of the wrapping k not completely cut off by the cutting means when the cutting means is positioned at the end portion cutting angle (α);

moving the cutting means axially along the center axis of the roll towards said second roll body end portion and at the same time rotating the roll about said center axis such that the wrapping on the envelope surface of the roll k cut in a helical manner, wherein the wrapping on the envelope surface of the roll is cut with the cutting means, the cutting means further inclining and forming an envelope surface cutting angle (β) in relation to the plane during cutting of the envelope portion, wherein said envelope surface cutting angle (β) is larger than said end portion cutting angle (α); and rotating the roll further about the center axis of the roll over the rotational angle (φ) less than 360 degrees, at the same time as the wrapping is cut by the cutting means at said second roll body end portion, the cutting means forming said end portion cutting angle (α), such that the wrapping is cut off the roll in one continuous piece.

2. The method of claim 1, wherein the cutting means is inclined by said envelope surface cutting angle (β) during the cutting of the wrapping along the envelope surface of the roll.

3. The method of claim 1, wherein said envelope surface cutting angle (β) is between 5 and 25 degrees.

4. The method of claim 3, wherein said envelope surface cutting angle (β) is between 10 and 20 degrees.

5. The method of claim 4, wherein said envelope surface cutting angle (β) is approximately 15 degrees.

6. The method of claim 1, wherein the wrapping on the respective roll body end portions is cut for less than a 360 degree rotation of the roll, with the cutting means inclined by the end portion cutting angle (α) which is between 0 and 10 degrees, in relation to said first end gable of said first roll body end portion.

7. The method of claim 6, wherein the end portion cutting angle (α) is between 0 and 5 degrees.

8. The method of claim 7, wherein the end portion cutting angle (α) is between 0 and 2 degrees.

9. The method of claim 1, wherein the wrapping is gripped by a collecting means, and wherein the cut off wrapping is gathered by the collecting means.

10. The method of claim 1, wherein the rotational angle (φ) is more than 270 degrees and less than 360 degree.

* * * * *